United States Patent [19]

Bland, Jr. et al.

[11] 4,186,872

[45] Feb. 5, 1980

[54] ALTERNATE PATH COOLING SYSTEM FOR LIQUID COOLED DEVICES SUCH AS ENGINES

[76] Inventors: William M. Bland, Jr., 18575 Martinique Dr., Nassau Bay, Tex. 77058; Edison M. Fields, 5314 Valkeith, Houston, Tex. 77096

[21] Appl. No.: 679,150

[22] Filed: Apr. 22, 1976

[51] Int. Cl.[2] ..... F01P 7/02

[52] U.S. Cl. ..... 236/34.5; 123/41.08; 137/512.1; 165/40

[58] Field of Search ..... 123/41.08, 41.15, 41.09, 123/41.29, 198 D, 41.1; 137/110, 512.1, 115; 236/34.5; 165/40

[56] References Cited

U.S. PATENT DOCUMENTS

| | | | |
|---|---|---|---|
| 2,098,712 | 11/1937 | Reynolds | 123/41.08 |
| 3,302,171 | 1/1967 | Sensing | 123/41.15 |
| 3,323,502 | 6/1967 | Whalen | 123/41.08 |
| 3,568,648 | 3/1971 | Cass | 123/41.15 |
| 3,590,798 | 7/1971 | Goodwin | 123/41.15 |
| 3,667,431 | 6/1972 | Kueny | 123/41.08 |
| 3,763,836 | 10/1973 | Guehr | 123/41.15 |
| 3,775,745 | 11/1973 | Kelley | 123/41.15 |
| 3,776,457 | 12/1973 | Cardi | 236/34.5 |
| 3,918,418 | 11/1975 | Horn | 123/41.08 |
| 4,011,988 | 3/1977 | Inagaki | 236/34.5 |

*Primary Examiner*—Albert W. Davis, Jr.
*Assistant Examiner*—Margaret A. Focarino

[57] ABSTRACT

This invention relates generally to the cooling of liquid-cooled devices such as engines, motors, transformers, and similar heat-producing or energy-conversion machines, that are designed to operate within specified temperature ranges.

2 Claims, 19 Drawing Figures

ALTERNATE PATH COOLING SYSTEM FOR LIQUID COOLED DEVICES SUCH AS ENGINES

The major object of this invention is to provide, by an alternate flow path, a fail-safe means of assuring that the flow of cooling fluids (coolant) will continue with the same capability for all device operating modes and without interruption, damage, or repair by its operator despite failure of the primary flow path to provide coolant flow.

A further object of this invention is to provide a means of alerting or warning the device operator when a failure of the primary flow path has occurred and that the alternate flow path has been (or should be) activated, so that the necessary repairs may be made at some convenient time to restore the original level of redundancy.

The basic concepts of this invention were described and registered with the Patent Office in Disclosure Document #044991.

BACKGROUND EXPLANATION

A liquid-cooled device, such as an engine or similar heat-producing device, must operate within specified temperature limits for two basic reasons: (1) if the engine operates at temperatures that are too low, inefficient operation and possible engine damage will result, and the engine may not respond properly to load changes; an example is the case of trying to accelerate an automobile rapidly when entering freeway traffic and the engine is cold; and (2) if the engine operates at temperatures that are too high, the engine will be damaged and will stop running due to differences of expansion of the various engine parts causing mechanical interferences and binding; an example is the case of an automobile engine stopping soon after its coolant is lost.

Coolant Flow for Normal Cooling System Operation

Traditionally, liquid-cooled devices such as engines have used a temperature-sensitive mechanism, usually called the thermostat, to control the flow of coolant. A typical arrangement is shown schematically in FIG. 7*a*. The engine block 21 produces heat which is carried to the radiator 24 (heat exchanger), and in the process the coolant flows through the conventional thermostat 22 (see FIG. 1*a* for details). A fan 31 is usually provided to aid air flow through the radiator 24 in order to assure sufficient cooling. A normal temperature sensor 27 is provided to activate the over-temperature display 29 when the engine temperature rises to a predetermined level that is considered to be detrimental to continued engine operation.

The sequence of operation is usually as follows when the engine and thermostat are operating normally: (1) the engine is usually started at a temperature lower than its normal operating limits, with the thermostat closed as it should be to prevent coolant flow to the radiator; (2) the engine and coolant heat up fairly quickly, due to the closed thermostat which does not permit coolant to circulate to the radiator, and all of the engine heat is used to raise the engine temperature; and (3) when the engine and coolant reach the designated temperature, which was pre-set for that particular engine and use circumstances, the thermostat opens and permits coolant to flow between the engine and radiator, where the excess engine heat is removed from the coolant. The coolant, now cooler, is returned to the engine and this continuous process goes on for as long as necessary to keep the engine temperature within normal operating limits. A pump is usually used to circulate the coolant between the engine and radiator, although gravity flow may be used in some cases.

The reason that the thermostat is designed to be in the closed position at engine startup and during the first few minutes of operation is that the engine needs to warm up quickly to its specified operating temperature.

Coolant Behavior for Failed-Closed Thermostat

In the event of failure of the thermostat in or to the closed position, the coolant flow cannot reach the radiator to give off heat and lower the temperature of the coolant and thus keep the engine temperature low. The engine and coolant temperature continue to rise, and eventually (usually within minutes) the coolant temperature reaches its boiling point. The coolant changes to a gas or vapor under these conditions, with a large increase in volume and pressure, and the resulting pressure forces the coolant rapidly from the engine and radiator. As soon as the coolant is exhausted, the engine temperature rises rapidly, the engine internal parts expand and bind and interfere with each other, and the engine stops. This engine stoppage can be dangerous to the engine operator and others under certain circumstances, such as the stoppage of an automobile engine on the freeway or in an isolated location, and generally damages the engine to a considerable extent.

PARTICULAR DETAILS OF THIS INVENTION

The major object of this invention is to provide an alternate flow path for the engine coolant, so that when the coolant primary flow path fails closed, the alternate flow path can be brought into operation and the coolant will continue to flow through the radiator and keep the engine temperature within specified limits. The alternate flow path is designed to provide a flow capacity equal to the task of taking over the entire function of the primary flow path.

A further object of this invention is to provide a means of warning or alerting the operator of the device or engine that a failure of the primary flow path has occurred, and that the alternate flow path has been (or should be) activated, so that the necessary repairs can be made at some convenient time to restore the original level of redundancy.

These objectives are accomplished by the structure and arrangement of parts described in the following specifications, claims, and figures. The actual physical arrangement of the components and assemblies can take many forms and shapes, and can be made of various materials; this applies to the primary and alternate paths for coolant flow, and to the valve-status and flow-path sensing and display methods.

SUMMARY

When the normal single-flow-path thermostat of a liquid-cooled device, such as a liquid-cooled engine, fails closed, the flow of coolant stops, and the engine rapidly heats up and quickly stops operating, sometimes within minutes, generally with resulting engine damage, and often in a situation of added risk for the engine operator. An example of such a situation is the case where an automobile engine stops suddenly on the freeway when the engine over heats due to loss of engine coolant. Such engine stoppages can be dangerous to life and properly.

The invention described herein incorporates a means of preventing stoppages of liquid-cooled devices when the coolant primary flow path is blocked, by providing an alternate flow path for the coolant. When the primary flow path for the coolant becomes blocked for any reasons, an alternate flow path for the coolant becomes active and assures continued coolant flow of sufficient quantity so that the device continues to operate indefinitely. The alternate flow path can be brought into play either automatically or manually.

A means is provided to alert and warn the device operator that the alternate flow path has been (or should be) activated so that appropriate repairs can be made at a convenient time to restore the original level of redundancy.

By the means noted in the preceeding paragraphs, and further described in this specification, uninterrupted device operation is assured, and danger to life and property are avoided.

For ease in explaining the application of this invention and describing its features, the use of this alternate-path cooling system on an automobile engine is used as an example; application to other devices using a liquid-cooled system would be similar.

DESCRIPTION OF DRAWINGS

In order to describe with the greatest clarity the principles involved in this invention, TABLE I and TABLE II are provided for reference and clarification.

TABLE I

List of Figures, With Descriptive Titles

Figure 1C:
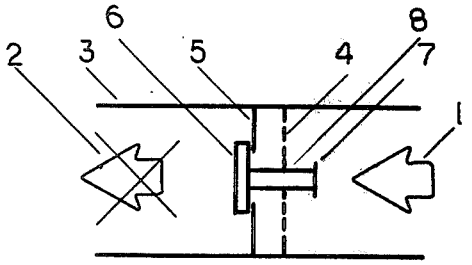
Figure 1A:
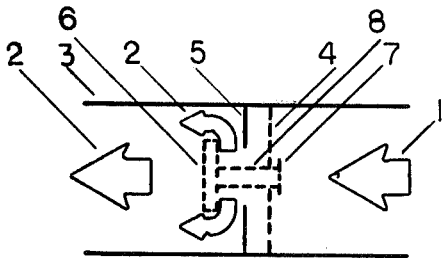

FIG. 1*a*—Cooling system with conventional thermostat-controlled primary flow path. Thermostat is open, and coolant is flowing normally.

Figure 1B:
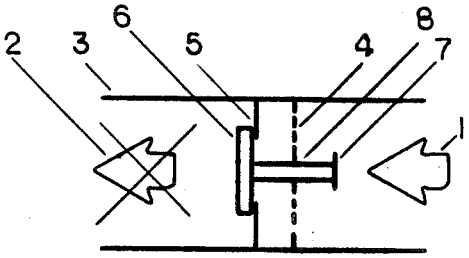

FIG. 1*b*—Cooling system with conventional thermostat-controlled primary flow path, with engine cool and thermostat still closed; coolant is not yet flowing.

FIG. 1*c*—Cooling system with conventional thermostat-controlled primary flow path, showing failed-closed-thermostat operation with flow blocked.

Figure 2B:
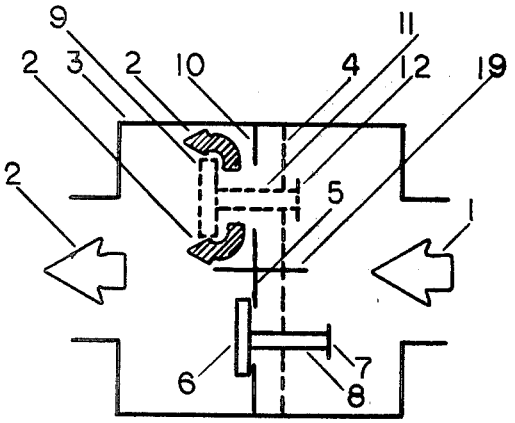
Figure 2A:
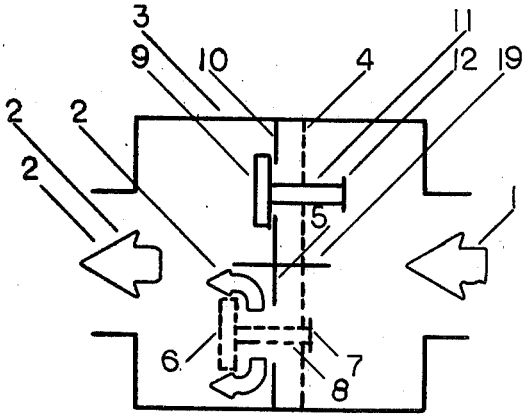

FIG. 2*a*—Alternate-path cooling system, showing both a thermostat-controlled primary flow path, and an alternate flow path added. Primary flow path is open, and alternate flow path is closed. Alternate flow path is designed to automatically open and close repeatedly. Alternate flow path opens/closes at a higher temperature than that of the primary flow path but can use a similar principle to cause opening/closing.

FIG. 2*b*—Same as FIG. 2*a*, except that primary flow path has failed closed, and the alternate flow path is open.

Figure 3B:
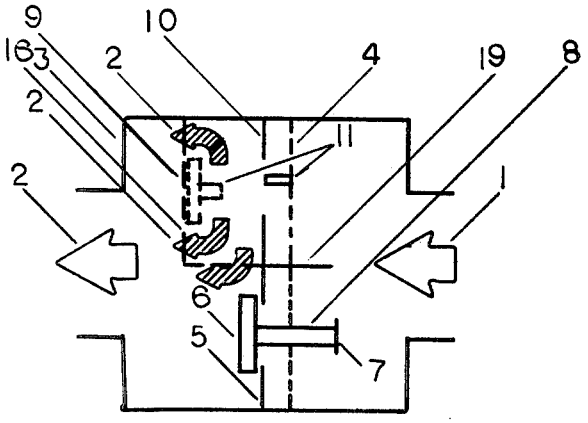
Figure 3A:
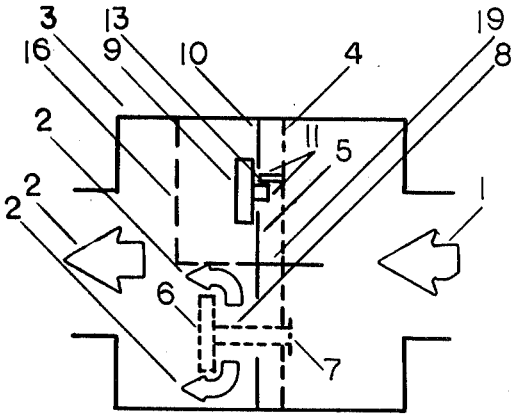

FIG. 3*a*—Alternate-path cooling system, showing both a thermostat-controlled primary flow path, and an alternate flow path added. Primary flow path is open, and alternate flow path is closed. The alternate flow path is designed to automatically open one time, and remain open until repaired. The alternate flow path opens at a higher temperature than that of the primary flow path, and uses a different principle.

FIG. 3*b*—Same as FIG. 3*a*, except that the primary flow path has failed closed, and the alternate flow path is open.

Figure 4B:
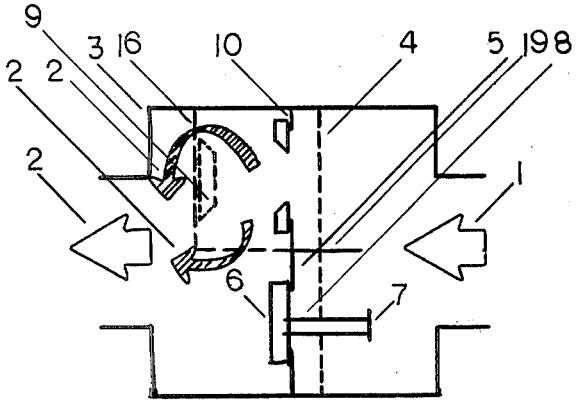
Figure 4A:
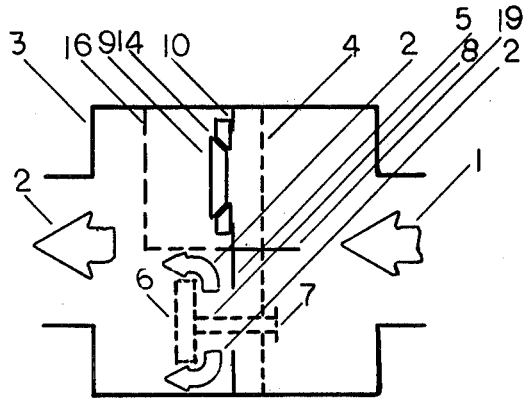

FIG. 4*a*—Alternate-path cooling system, showing both a thermostat-controlled primary flow path, and an alternate flow path added. Primary flow path is open, and alternate flow path is closed. The alternate flow path is designed to automatically open one time and remain open until repaired. The alternate flow path opens at a higher temperature than that of the primary flow path, and uses a different principle.

FIG. 4*b*—Same as FIG. 4*a*, except that the primary flow path has failed closed, and the alternate flow path is open.

Figure 5B:
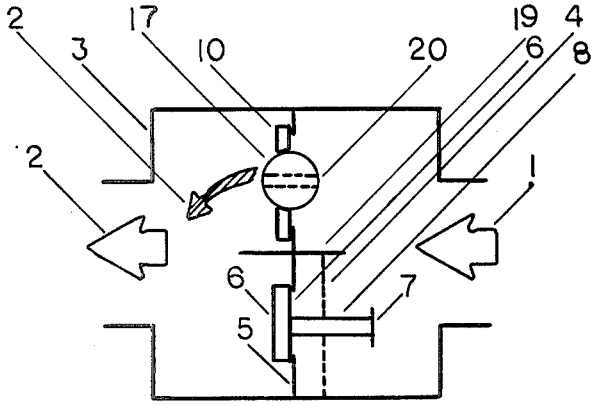
Figure 5A:
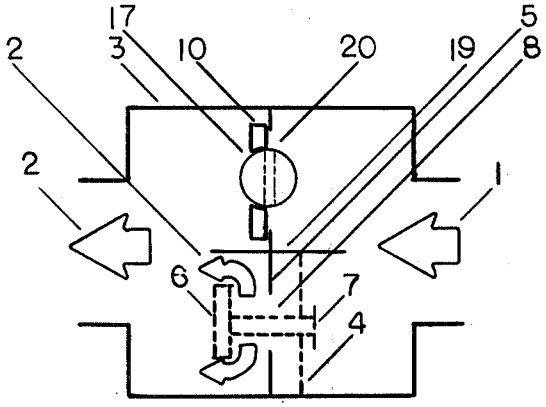

FIG. 5*a*—Alternate-path cooling system, showing both a thermostat-controlled primary flow path, and an alternate flow path added. Primary flow path is open, and alternate flow path is closed. The alternate flow path is designed to be activated physically and can be repeatedly opened and closed.

FIG. 5*b*—Same as FIG. 5*a*, except that the primary flow path has failed closed, and the alternate flow path is open.

Figure 6B:
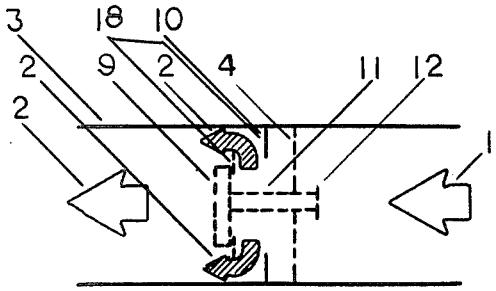
Figure 6A:
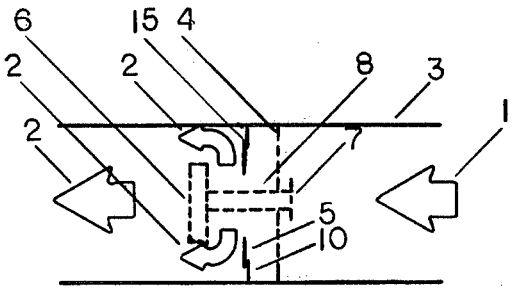

FIG. 6*a*—Alternate-path cooling system, showing both a thermostat-controlled primary flow path, and an alternate flow path added, all co-axially mounted in the same flow channel. The primary flow path is open, and the alternate flow path is closed. The alternate flow path is designed to open one time and remain open until repaired. The alternate flow path opens at a higher temperature than that of the primary flow path, and uses a different principle.

FIG. 6*b*—Same as FIG. 6*a*, except that the primary flow path has failed closed, and the alternate flow path is open.

Figure 7B:
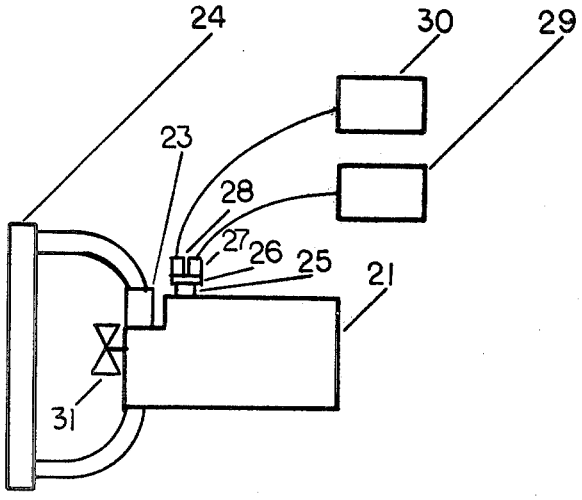
Figure 7A:
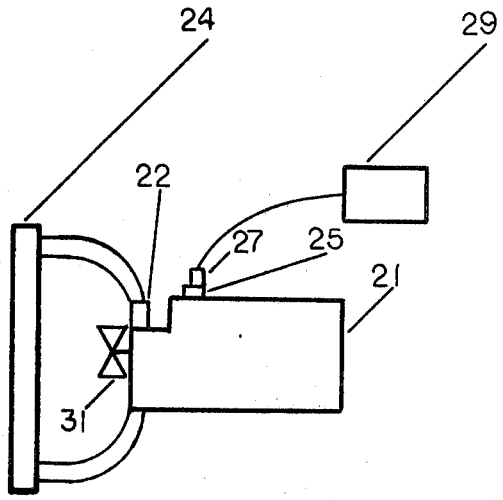

FIG. 7*a*—Schematic representation of typical engine and coolant-flow system, with conventional thermostat-controlled primary flow path only, and conventional method of alerting engine operator of an engine high-temperature condition.

FIG. 7*b*—Same as FIG. 7*a*, except that the alternate-path cooling system has been added, and a typical method of alerting the engine operator has been added to signal the operator that the alternate flow path has been (or should be) activated.

Figure 8B:
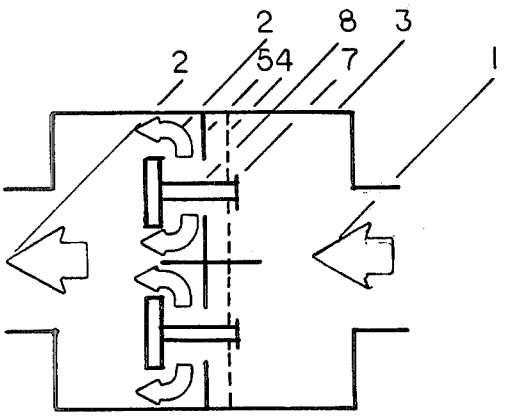
Figure 8A:
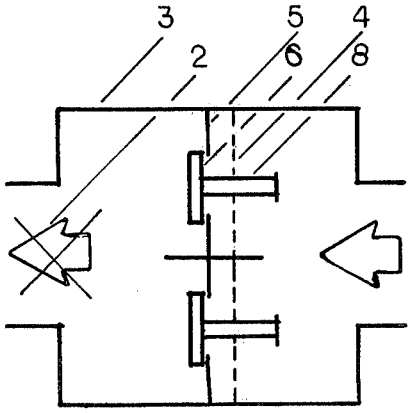

FIGS. 8*a* and 8*b*—cooling system with primary and secondary flow paths controlled by two normally-operating identical thermostat assemblies. FIG. 8*a* shows the cooling system in a cool condition before engine start, with both thermostats closed. FIG. 8*b* shows the cooling system in a normal-operation condition after engine start, with both thermostats open.

Figure 8D:
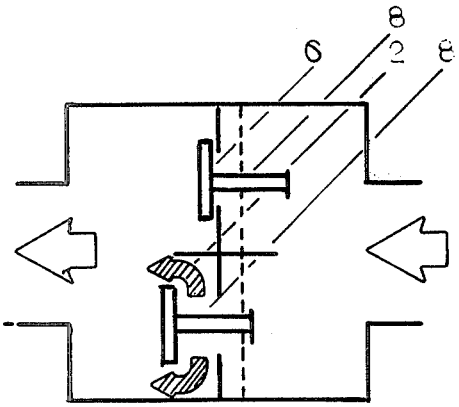
Figure 8C:
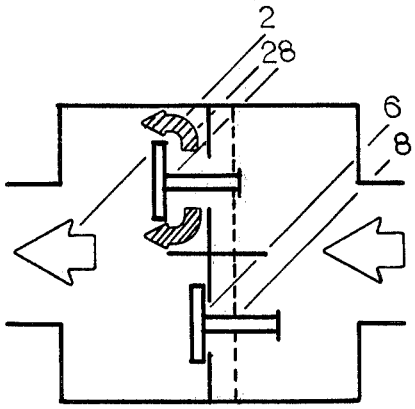

FIGS. 8*c* and 8*d*—Same as FIG. 8*b*, except that the primary flow path has failed closed (FIG. 8*c*) or the alternate flow path has failed closed (FIG. 8*d*), and that the remaining flow path in each case has remained open to provide a cooling flow path.

TABLE II

List of part numbers with descriptions

| Part No. | Part description |
|---|---|
| 1 | Incoming coolant from heat source, such as engine block |
| 2 | Outgoing coolant to radiator, with flow direction indicated by arrows. Unshaded arrows indicate primary-path flow, and cross-hatched arrows indicate alternate-path flow. |
| 3 | Alternate-path cooling system housing; any appropriate cross-section can be used. |
| 4 | Grid, to guide and support movable parts, and to anchor the opening/closing mechanisms where necessary. |
| 5 | Valve seat, that movable part closes against to prevent flow in the primary flow path. |
| 6 | Movable part in the primary flow path. |

TABLE II-continued

| Part No. | List of part numbers with descriptions<br>Part description |
|---|---|
| 7 | Flange on end of valve stem of movable part in primary flow path. |
| 8 | Valve stem of movable part in primary flow path. |
| 9 | Movable part in alternate flow path. |
| 10 | Valve seat, that movable part closes against to prevent flow in alternate flow path. |
| 11 | Valve stem of movable part in alternate flow path. |
| 12 | Flange on end of valve stem of movable part in alternate flow path. |
| 13 | Temperature-sensitive fusible alloy joint holding two parts of valve stem together in alternate flow path. |
| 14 | Temperature-sensitive fusible alloy joint holding movable part against valve seat in alternate flow path. |
| 15 | Temperature-sensitive fusible alloy joint holding movable part against valve seat in alternate flow path, for co-axial arrangement. |
| 16 | Catch basket to restrain the freed movable parts when alternate flow path opens. |
| 17 | Rotatable valve in alternate flow path. |
| 18 | Separated temperature-sensitive fusible alloy joint of alternate flow path for co-axial arrangement. |
| 19 | Alternate-path-cooling-system housing internal arrangement used to separate primary flow path from alternate flow path. |
| 20 | Flow passageway through rotatable valve. |
| 21 | Engine block. |
| 22 | Conventional single-flow-path thermostat through which coolant flows from heat source (engine) to radiator. |
| 23 | Alternate-path cooling system that provides a primary flow path, and alternate flow path(s), from heat source (engine) to radiator. |
| 24 | Radiator (heat exchanger) |
| 25 | Conventional temperature sensor housing at appropriate location in engine block. |
| 26 | Adapter to accomodate two temperature sensors in a conventional temperature sensor installation boss. |
| 27 | Conventional temperature sensor which closes to activate display 29 when engine is overheated. |
| 28 | Alternate-path-cooling-system temperature sensor which closes to activate alternate-path-cooling-system display 30 when engine temperature has increased enough over normal operating temperature to activate alternate flow path or to alert operator to activate manually-activated alternate flow path. This sensor system should cause the warning light or horn to remain "on" to alert the operator, since a conventional sensor system would return to "off" as soon as the alternate flow path is activated and the temperature returns to normal. Additionally, a manual deactivation system can be added to the warning display or horn, if the continued "on" signal would be distracting. |
| 29 | Conventional (for example, red) over-temperature visual warning light, to warn of overheated engine. |
| 30 | Alternate path cooling system alternate flow path visual warning light (for example, yellow), to indicate that alternate flow path has been activated. |

The sketches and part descriptions listed in TABLES I and II immediately preceeding show schematically the methods of accomplishing the objectives of this invention; the additional discussion following will further clarify the methods and principles involved.

It will be obvious to those trained and skilled in the basic engineering disciplines that the schematics shown as part of this specification are merely typical illustrations of a basic principle, this principle being the heart of the patent. This principle is one of providing an alternate path for engine coolant to flow through when the primary flow path is blocked by failure of a thermostat. Several methods of providing such an alternate flow path are illustrated in this specification, but it should be noted that other methods of providing such an alternate path may be utilized; these other methods are not illustrated or described herein. Design and construction of actual devices can result in various shapes and sizes, with the use of appropriate materials, to fit the needs of the conditions to which the basic objectives and claims of this invention are applied.

DETAILED DESCRIPTION OF INVENTION

Referring in detail to FIGS. 1*a*, 2*a*, 3*a*, 4*a*, 5*a*, and 6*a*, each of these figures represent the normal operation of the coolant primary flow path, with the engine operating within its specified temperature range, and utilizing a conventional thermostat for flow control. Note that only the primary and alternate flow path portions of the engine coolant loop are shown, since this is the only part of the coolant loop that the objectives of this invention are concerned with. In each of the figures the normal, or primary, flow path is open and the coolant is flowing in a normal manner and volume, sufficient to keep the engine temperature within specified limits. The specific methods used to accomplish this normal operation are varied, but the following is typical. The coolant 1 flows through the opening provided by the movable part 6 which has been caused to move to the position shown by the action of a temperature-sensitive material such as a bimetallic spring (not shown) attached at one end to the grid 4 and at the other end to the movable part 6 or the valve stem 8. In such an arrangement, the temperature of the coolant 1 causes the spring to expand and push the movable part 6 away from both the grid 4 and valve seat 5, both of which are fixed to the housing 3. This movement of the movable part 6 away from the valve seat 5 opens the primary flow path, permitting incoming coolant 1 to flow through and proceed as outgoing coolant 2 to the radiator. The grid 4 also serves the added function of guiding the valve stem 8 and providing a stop for the flange 7 which prevents the stem 8 from moving so far that it cannot return to the closed position when the incoming coolant 1 temperature returns to the cool condition after the engine stops. When the engine is shut off and cools down, the coolant also cools down and causes the spring to retract. This retraction causes the movable part 6 to move back toward the grid 4 and seats the movable part 6 against the seat 5 thus closing the flow path in preparation for a cold-engine start.

Referring in detail to FIGS. 1*b* and 1*c*, both represent the conventional thermostat-controlled single flow path. FIG. 1*b* represents the normal operation of the engine and coolant where the engine has just been started but has not yet warmed up, and as a result the movable part 6 has not moved and opened the flow path. In FIG. 1*c*, the thermostat is shown as it would be in the failed-closed position, and as a result no flow is permitted. In such a situation, the coolant would not be passed through the radiator (heat exchanger) since the path is blocked, thus the coolant would quickly heat up and boil away. The engine would then overheat and would have to be stopped to prevent damage, or if the temperature increase went unnoticed the engine would stop with serious consequences and/or damage.

Referring in detail to FIG. 2*a*, the top part of the figure incorporates a feature of this invention and shows an alternate path for coolant flow. However, since the primary flow path is operating, as shown in the bottom part of the figure, this alternate path has not been activated.

Referring now in detail to FIG. 2*b*, the bottom part of this figure shows the primary flow path blocked by a failed-closed primary flow path thermostat. The top part of this figure shows the alternate flow path open and permitting incoming coolant 1 to flow through the alternate flow path and emerge as outgoing coolant 2 to the radiator. The method of opening and closing the alternate flow path in this figure is fundamentally similar to that of the primary flow path, the difference being that the alternate flow path movable part 9 is controlled by a temperature-sensitive assembly with different temperature characteristics than those of the primary flow path. The temperature characteristics of the mechanism in the alternate flow path are such that the movable part 9 does not open the alternate flow path until the incoming coolant 1 temperature has risen a selected incremental amount (for example, 50 deg F) above the normal operating range of the engine but still within the "no damage" temperature limits.

Still referring in detail to the top part of FIG. 2*b*, a variation on the arrangement described above would be to use two essentially-identical thermostat assemblies, mounted side by side in a single housing as shown in FIGS. 8*a*, 8*b*, 8*c*, and 8*d*. In normal operation, both would be open when the engine was in its normal operating temperature range, with each assembly being large enough to provide all the needed flow of coolant. In case one of the assemblies failed closed, the likelihood would be that the other would not fail closed at the same time, and therefore would continue to provide the necessary incoming coolant 1 and outgoing coolant 2 flow. In this case, detection of failure in one path would be by some form of physical inspection or sensing of lack of mechanical motion of the failed part.

Referring in detail to FIG. 3*a*, the top part of this figure incorporates a feature of this invention and shows an alternate coolant flow path arrangement. However, since the primary flow path is operating, as shown in the bottom part of this figure, this alternate path has not been activated.

Referring now in detail to FIG. 3*b*, the bottom part of this figure shows the primary flow path blocked by a failed-closed primary-flow-path thermostat. The top part of this figure shows the alternate flow path open and permitting incoming coolant 1 to flow through the alternate flow path and emerge as outgoing coolant 2 to the radiator. The method of opening the alternate flow path is through the melting of a temperature-sensitive fusible alloy 13 (see FIG. 3*a*). This alloy holds the two parts of the valve stem 11 together until the temperature of the incoming coolant 1 has risen a selected predetermined amount (for example, 50 deg F.) above the normal operating temperature, at which temperature the fusible alloy 13 melts and the movable part 9 drops free. The movable part 9 must be prevented from moving about through the engine and cooling loop, so a restraining arrangement such as the catch basket 16 must be provided.

It should be noted that the temperature-sensitive fusible alloy actual melting temperature for a particular liquid-cooled device and its operating environment can be selected over a wide range of melting temperatures of the fusible alloy. Temperature-sensitive fusible alloys, or similar solid low-melting-point materials, may be chosen from a variety of materials for the particular application. The melting temperature chosen should be high enough so that a normally-operating engine running at a hot (but still safe) temperature will not melt the fusible alloy and cause a nuisance activation of the alternate flow path. At the same time this selected melting temperature must be low enough to melt and actuate the alternate path without allowing temperatures to go high enough to damage the engine.

Referring in detail to FIG. 4*a*, the top part of the figure incorporates a feature of this invention and shows an alternate coolant flow arrangement. However, since the primary flow path is operating, as shown in the bottom part of this figure, this alternate flow path has not been activated.

Referring now in detail to FIG. 4*b*, the bottom part of this figure shows the primary flow path blocked by a failed-closed primary flow path thermostat. The top part of this figure shows the alternate flow path open and permitting incoming coolant 1 to flow through the alternate flow path and emerge as outgoing coolant 2 to the radiator. The method of opening the alternate flow path is again through the use of a temperature-sensitive fusible alloy in a manner similar to that described in FIG. 3*b*. The alloy is chosen to melt when the incoming coolant 1 temperature has risen a selected incremental amount (for example, 50 deg F.) as desired for the particular engine and its application. In this case, the movable part 9 is held in place by the fusible alloy 14 (see FIG. 4*a*) around the periphery of the movable part 9. When the incoming coolant 1 temperature rises to the melting temperature of the fusible alloy 14, it melts and releases the movable part 9 to move along with the incoming coolant 1 stream and thus opens the alternate flow path and permits the outgoing coolant 2 to flow to the radiator. A catch basket 16 is provided to restrain the movable part 9 from further movement through the engine and cooling loop.

Referring in detail to FIG. 5*a*, the top part of this figure incorporates a feature of this invention and shows an alternate coolant flow arrangement. However, since the primary flow path is operating, as shown in the bottom part of this figure, this alternate flow path has not been activated.

Referring now in detail to FIG. 5*b*, the bottom part of this figure shows the primary flow path blocked by a failed-closed primary-flow-path thermostat. The top part of this figure shows the alternate flow path open and permitting incoming coolant 1 to flow through the alternate flow path and emerge as outgoing coolant 2 to the radiator. The method of opening the alternate flow path is by rotation of the flow-through rotatable valve 17 one-quarter turn. This valve has a flow passage 20 through its approximate center, and this valve 17 can be rotated so as to close off the flow or permit flow through the valve 17 as desired. The rotation of the valve 17 can be accomplished physically, either at the valve 17 by an extension of the valve 17 shaft, or remotely by the appropriate extension of the shaft with gears and universals if necessary, or electrically through solenoid rotation of the valve 17 shaft. The solenoid actuation can be manually initiated from a remote distance, such as by the driver of an automobile who would press a button on the dashboard of the car, or the solenoid can be automatically actuated by a sensing device which responds to the higher temperatures resulting from the failure of the primary flow path thermostat. The manual rotation for the activation of the alternate flow path can be done at any time without interfering with the engine cooling loop operation; however, it is intended to principally be operated when the operator through the use of any of the various sensors decides that the primary flow path has failed in the closed position.

An additional feature of this invention is that the rotatable valve can be substituted for by a wide variety of other valve types that operate by a physical movement of a portion of the valve assembly relative to the remainder of the assembly.

Referring in detail to FIG. 6*a*, this figure incorporates a feature of this invention, although the alternate flow path arrangement is not immediately apparent. Since the primary flow path is operating, as shown in this figure, the alternate flow path has not been activated.

Referring now in detail to FIG. 6*b*, this figure shows the primary flow path blocked by a failed-closed primary-flow-path thermostat. The alternate flow path is open and permitting incoming coolant 1 to flow through the alternate flow path and emerge as outgoing coolant 2 to the radiator. The method of opening the alternate flow path is again through the use of a temperature-sensitive fusible alloy in a manner similar to that described in FIG. 3*b*. The alloy is chosen to melt when the incoming coolant 1 temperature has risen a selected incremental amount (for example, 50 deg F.) as desired for the particular engine and its application. In this case, the seat 5 that the movable part 6 closes against is secured to the alternate-flow-path seat 10 by a fusible alloy 15 (see FIG. 6*a*) around the periphery of the seat 10. When the primary flow path movable part 6 fails closed and the incoming coolant 1 temperature rises to the preselected value, the fusible alloy 15 melts and permits the movable part 6 plus the valve seat 5 to both move downstream and open up the alternate flow path for the outgoing coolant 2 to flow to the radiator. The flange 7 prevents continued movement downstream after opening a sufficient amount to permit the necessary volume to flow.

In all of the preceeding descriptions, a single alternate flow path has been described. It is obvious that the descriptions apply equally well to more than one alternate flow path, and thus multiple alternate flow paths are considered to be a part of this patent.

Generally, the engine operator should be alerted when the primary flow path has failed closed and the alternate flow path has been (or should be) activated. This alert can be accomplished in a number of ways using either visual or audible signals or a combination of both to signal the operator.

Referring in detail to FIG. 7*a*, this figure shows a conventional method of alerting an engine operator that the engine temperature is higher than desired. In this conventional method, the temperature sensor 27 is mounted in the housing 25 which is in an appropriate location in the engine block 21. This temperature sensor is designed to close an electrical circuit at a preselected temperature and light up a warning light (for example, red) 29 as a warning of an overtemperature condition.

Referring now to FIG. 7*b*, a special provision is shown for alerting the engine operator that the alternate flow path has been activated. This special provision is the installation of a sensor 28 that is pre-set to close at a temperature above that which causes activation of the alternate flow path. In this manner, a warning (for example, amber) light 30 is activated or a warning signal is sounded and the engine operator is alerted that the alternate flow path has been (or should be) activated. Although this figure shows the flow-path-indicator sensor 28 mounted in an adapter 26 designed to accomodate both sensors 27 and 28, the flow-path-indicator sensor 28 can be mounted separately at any desired location.

A method of sensing that the automatically-activated alternate flow path has been activated is to sense the movement of internal parts of the alternate flow path valve; the sensing of movement can be either by direct observation, or remotely. A typical method of visual sensing is to construct the alternate flow path housing 3 of a transparent material so that visual observation of the alternate flow path opening could be made at any time. A typical method of remote sensing is to mount a magnet on the internal moving part 9 and mount a magnetic switch nearby externally or internally to sense any movement of the movable part. Alternate methods of sensing activation of the alternate path would be by detection of flow conditions or presence of coolant.

From any of the above-described methods of alerting the engine operator, the operator is informed that the alternate flow path has been (or should be) activated and that while not in jeopardy at that time subsequent to activation, the operator should at some early convenient time have the primary flow path repaired and the alternate flow path suitably repaired or refurbished and placed back into standby status.

Referring in detail to FIGS. 8*a*, 8*b*, 8*c*, and 8*d*, which incorporate features of this invention and show two paths for coolant flow with each path being capable of providing the full coolant flow rate and with each path equipped with essentially identical thermostat assemblies. FIG. 8*a* represents the normal operation of the engine and coolant where the engine has just been started but has not yet warmed up, and as a result the movable parts 6 of the thermostat assemblies have not moved and opened the flow paths, thus not allowing flow as indicated by crossed arrowhead 2. FIG. 8*b* represents the normal operation of the engine and coolant where the engine and coolant have warmed up and the coolant has reached the operating temperature of the thermostat assemblies and both have opened and are permitting flow through each thermostat assembly as indicated by arrows 2 through the thermostat housing 3. FIG. 8*c* represents the case of the operation of the engine and coolant where the temperature of the coolant has reached the operating temperature of the thermostat assemblies but the thermostat assembly in the top of the figure has failed to open and the other is in the normal open position providing full coolant flow rate. FIG. 8*d* also represents the case of the operation of the engine and coolant where the temperature of the coolant has reached the operating temperature of the thermostat assemblies, but the thermostat assembly in the bottom of the figure has failed to open and the other is in the normal open position providing full coolant flow rate. Since each flow path was constructed to be capable of providing full coolant flow rate, either path becomes the full alternate path in event the thermostat assembly fails to open in the other path.

From the foregoing descriptions, it can be readily seen that the herein described devices substantially fulfill the objectives of the invention, as set forth herein.

While this specification sets forth example arrangements and operations of the parts and devices in schematic form as applied to an automobile engine, actual implementation may result in deviations and variations from the specific detail described herein and still not be a departure from the principles and spirit of the invention as described by the appended claims.

It should be noted that a number of methods may be used to actuate the alternate flow path. In particular, once the overtemperature condition is sensed, the alternate flow path may be opened by the operator's energizing any one of several types of energy-storage methods such as batteries, pressure vessels, pyrotechnics, etc., that in turn would electrically or mechanically open up an alternate flow path. Employment of all such arrangements are considered to be within the scope and spirit of this invention.

Having thus described the concepts and substance and spirit of the invention, the following is claimed as new and useful, and upon which Letters Patent are desired:

1. A coolant temperature-control assembly outer housing, said housing being connected at one of its ends to a heat producing device and connected at its other end to a liquid coolant radiator, said housing being divided internally into two coolant flow passages with both passages being the same size and with each passage being capable of providing the full coolant flow rate required by the heat producing device, and each said passage having a valve attached internally by suitable means to the housing for the purpose of controlling the flow of coolant independently through each passage between the heat producing device and the said liquid coolant radiator, with each passage so proportioned that either of said passages can provide the required full coolant flow through all phases of heat producing device operation with the other passage failed closed, without interruption of heat producing device operation, or any damage, repair, adjustment, or maintenance to the heat producing device, or knowledge of the occurrence of the failure by the operator of the heat producing device, with said valves being thermostat valves of conventional construction and alike in all respects and each containing a movable part that is caused to open and close in response to the temperature of the coolant surrounding the valve, with both valves opening at the same preset temperature.

2. A coolant temperature-control assembly, as in claim 1, wherein the heat producing device is an engine such as an automobile engine.

* * * * *